US010202727B1

(12) United States Patent
Surles

(10) Patent No.: US 10,202,727 B1
(45) Date of Patent: Feb. 12, 2019

(54) GRAVITY DRAWBRIDGE

(71) Applicant: Ernest Morgan Surles, Port Orange, FL (US)

(72) Inventor: Ernest Morgan Surles, Port Orange, FL (US)

( * ) Notice: Subject to any disclaimer, the term of this patent is extended or adjusted under 35 U.S.C. 154(b) by 0 days.

(21) Appl. No.: 16/101,365

(22) Filed: Aug. 10, 2018

Related U.S. Application Data

(60) Provisional application No. 62/543,756, filed on Aug. 10, 2017.

(51) Int. Cl.
*E01D 15/00* (2006.01)
*E01D 15/08* (2006.01)

(52) U.S. Cl.
CPC ..... *E01D 15/08* (2013.01)

(58) Field of Classification Search
CPC ..... E01D 15/08
USPC ..... 14/31–50
See application file for complete search history.

(56) References Cited

U.S. PATENT DOCUMENTS 2,035,193 A * 3/1936 Russell ..... E01D 15/06 14/39
2,411,480 A * 11/1946 Temple ..... E01D 15/06 14/36
2,887,191 A * 5/1959 Lovell ..... E04H 12/187 14/36
3,308,496 A * 3/1967 Mooney ..... E01D 15/06 14/36
3,394,420 A * 7/1968 Popov ..... E01D 15/02 14/42
8,590,085 B1 * 11/2013 Smith ..... E01D 15/145 14/27
2003/0221266 A1 * 12/2003 King, Jr. ..... E01D 15/10 14/31

* cited by examiner

*Primary Examiner* — Raymond W Addie

(57) ABSTRACT

A gravity drawbridge is a moveable bridge that utilizes gravity and fluid transport to transition a bridge deck between an open configuration and a closed configuration. The gravity bridge includes a fulcrum, a first fluid reservoir, a second fluid reservoir and a fluid pump. The first fluid reservoir and the second fluid reservoir are internally mounted within the bridge deck. The first fluid reservoir and the second fluid reservoir are in fluid communication to each to transport a quantity of fluid between the first fluid reservoir and the second fluid reservoir using the fluid pump. The bridge deck rotates about the fulcrum as the quantity of fluid is transported between the first fluid reservoir and the second fluid reservoir to transition the bridge deck between the open configuration and the closed configuration.

11 Claims, 10 Drawing Sheets

GRAVITY DRAWBRIDGE

The current application claims a priority to the U.S. Provisional Patent application Ser. No. 62/543,756 filed on Aug. 10, 2017.

FIELD OF THE INVENTION

The present invention relates generally to a bridge. More specifically, the present invention relates to a drawbridge that raises or lowers through the displacement of a fluid within a deck of the bridge.

BACKGROUND OF THE INVENTION

Bridges and other similar civil structures enable users to cross large bodies of water or span physical obstacles to allow effective travel through the region. Since the development of wheeled vehicles, regulation over crossing bodies of water has become paramount as the travel distance is significantly reduced from circumnavigating the natural topography of the region. The ability to ensure the integrity of the bridge, control traffic across the bridge deck, and accommodate for tall vehicles passing under the bridge is made possible through the use of drawbridges. Drawbridges allows for travel across bodies of water and accommodate tall watercrafts that may collide with a static bridge due to the topography of the region.

However, drawbridges have a plurality of disadvantages. Drawbridges generally require a large energy input to lift and lower the bridge deck. Due to heavy loads from the weight of the drawbridge, degradation will occur over time and result in failure of drawbridge components. A high amount of energy is consumed from lifting the weight of the bridge deck, as a result a drawbridge has large battery and power requirements which can drain municipal and federal resources over time.

Therefore, an object of the present invention is a modified drawbridge that can be raised or lowered through minimal electrical input. The present invention is a gravity drawbridge that uses a fluid pump, a first fluid reservoir, and a second fluid reservoir to counterbalance a bridge deck to facilitate the rotation about a fulcrum to raise or lower the bridge deck. Advertisements may be placed places beneath the present invention, along with a set of solar panels, to reduce operations costs. The present invention may even produce excess energy for use by municipalities. Without gears and few moving parts, the degradation of the present invention is minimized.

DETAIL DESCRIPTIONS OF THE INVENTION

All illustrations of the drawings are for the purpose of describing selected versions of the present invention and are not intended to limit the scope of the present invention.

The present invention is a gravity drawbridge. The present invention reduces the mechanical input needed to raise or lower a traditional movable bridge by utilizing the weight of a contained fluid. By shifting the weight of the fluid throughout the present invention, the present invention is able to be positioned in an open configuration or a closed configuration to manipulate traffic patterns across or under the present invention. The open configuration allows tall vehicles or watercrafts to pass beneath the bridge while the closed configuration allows pedestrians or land vehicles to travel across the present invention.

Figure 1:
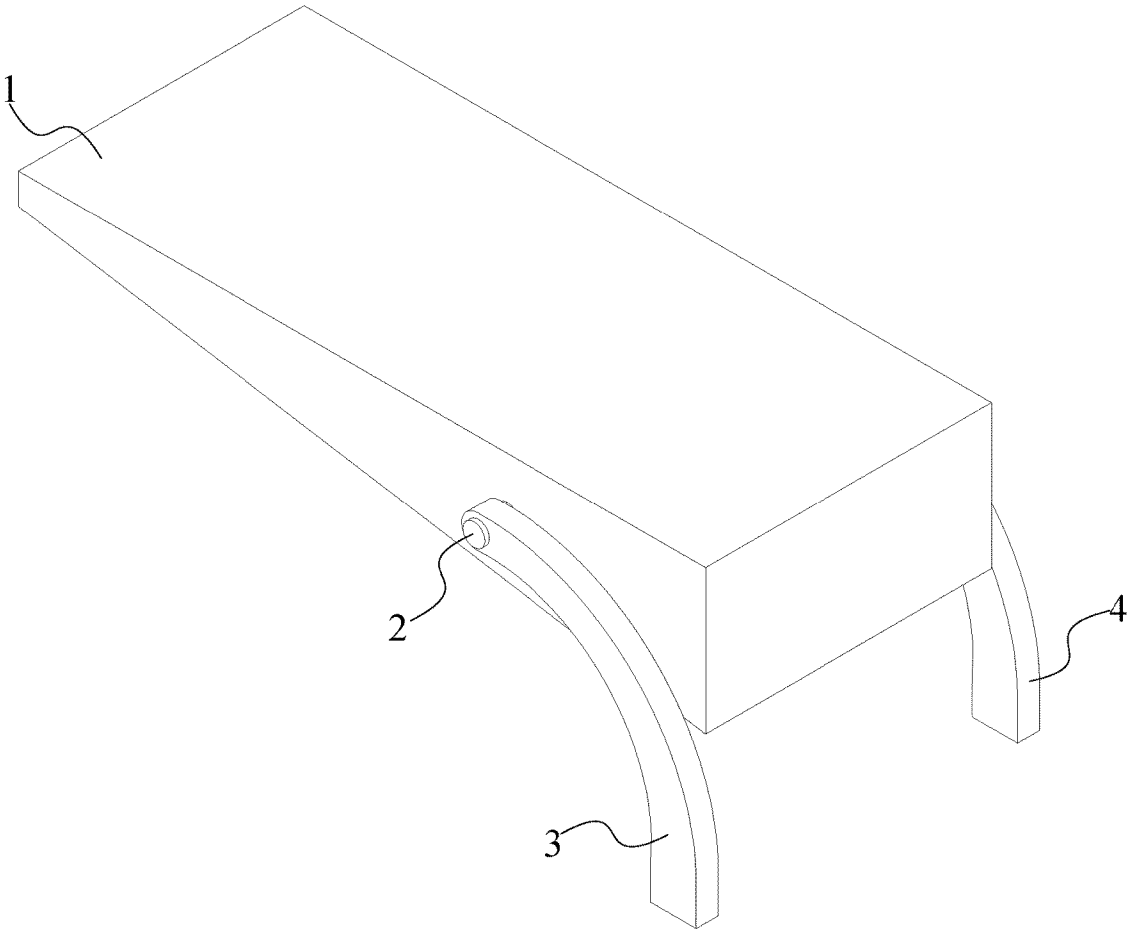
FIG. 1 is perspective view of the present invention, wherein the present invention is configured in the closed configuration.
Figure 2:
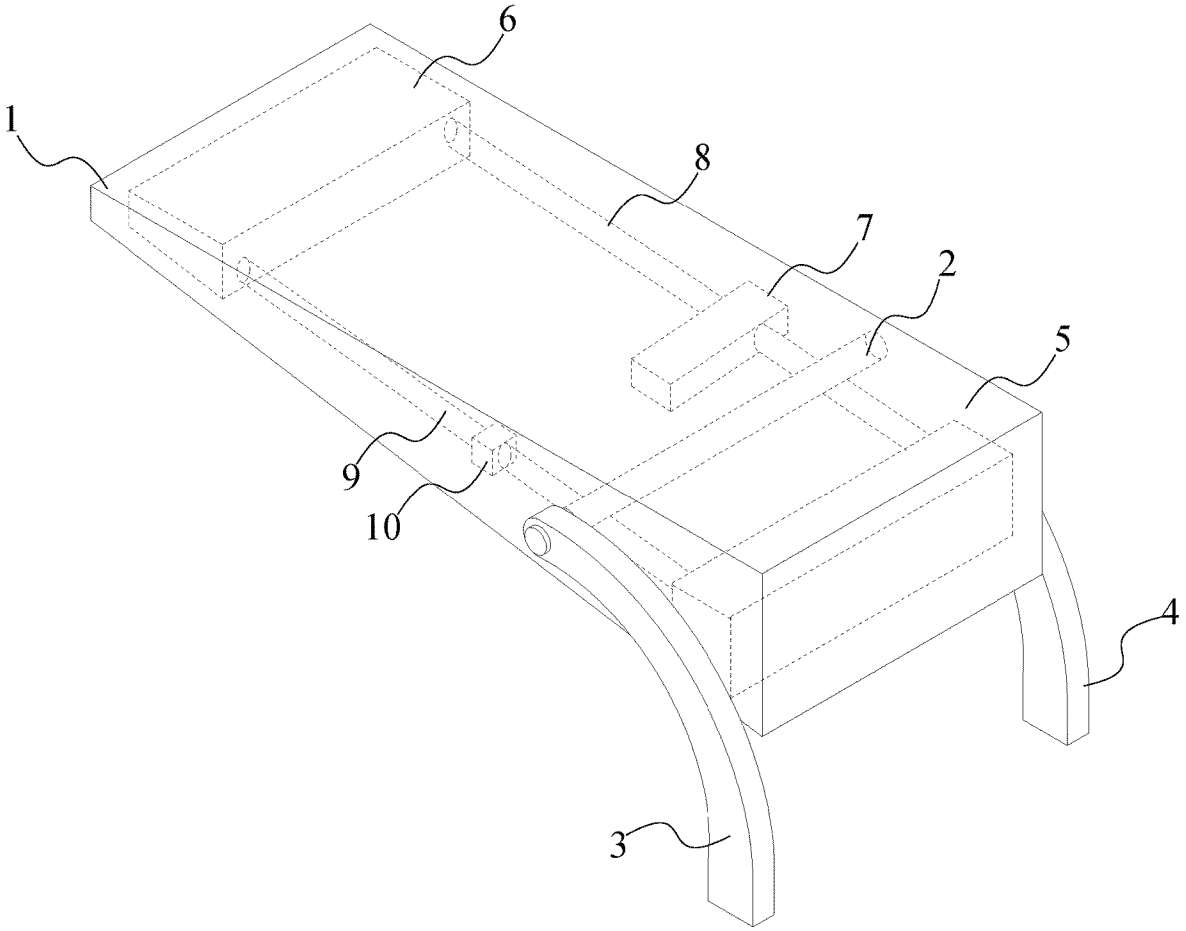
FIG. 2 is perspective view of the present invention, detailing the components mounted within the bridge deck.
Figure 3:
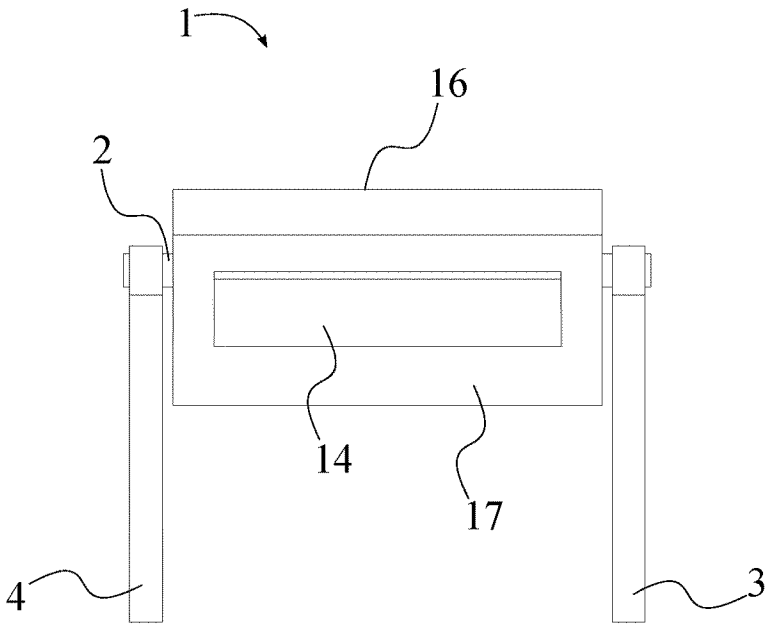
FIG. 3 is a front view of the present invention, wherein the present invention is configured in the closed configuration.
Figure 4:
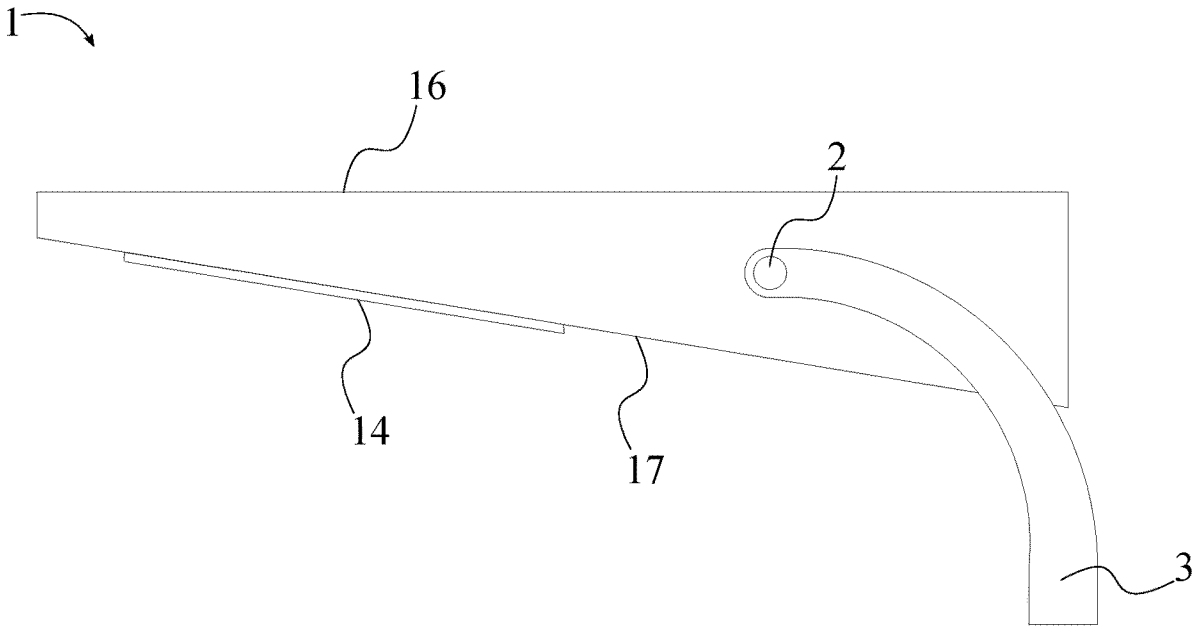
FIG. 4 is right view of the present invention, wherein the present invention is configured in the closed configuration.
Figure 5:
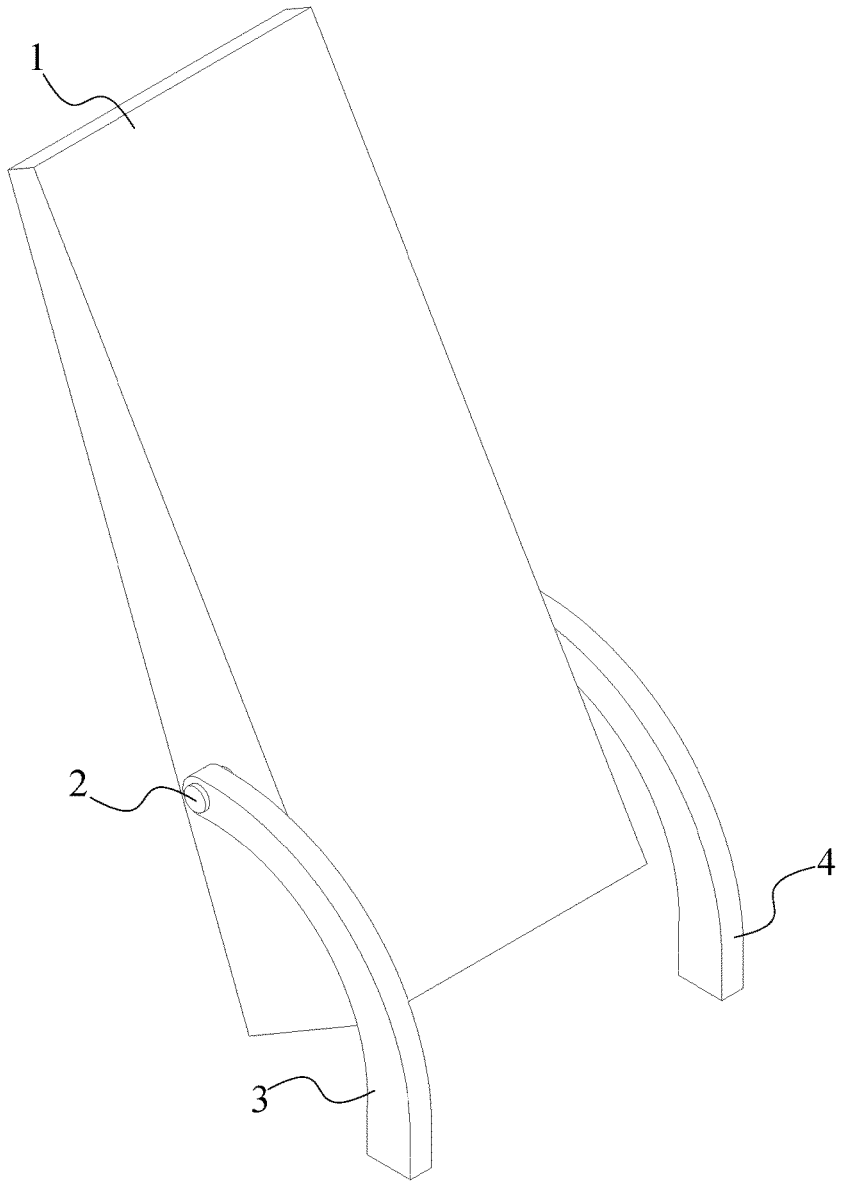
FIG. 5 is perspective view of the present invention, wherein the present invention is configured in the open configuration.
Figure 6:
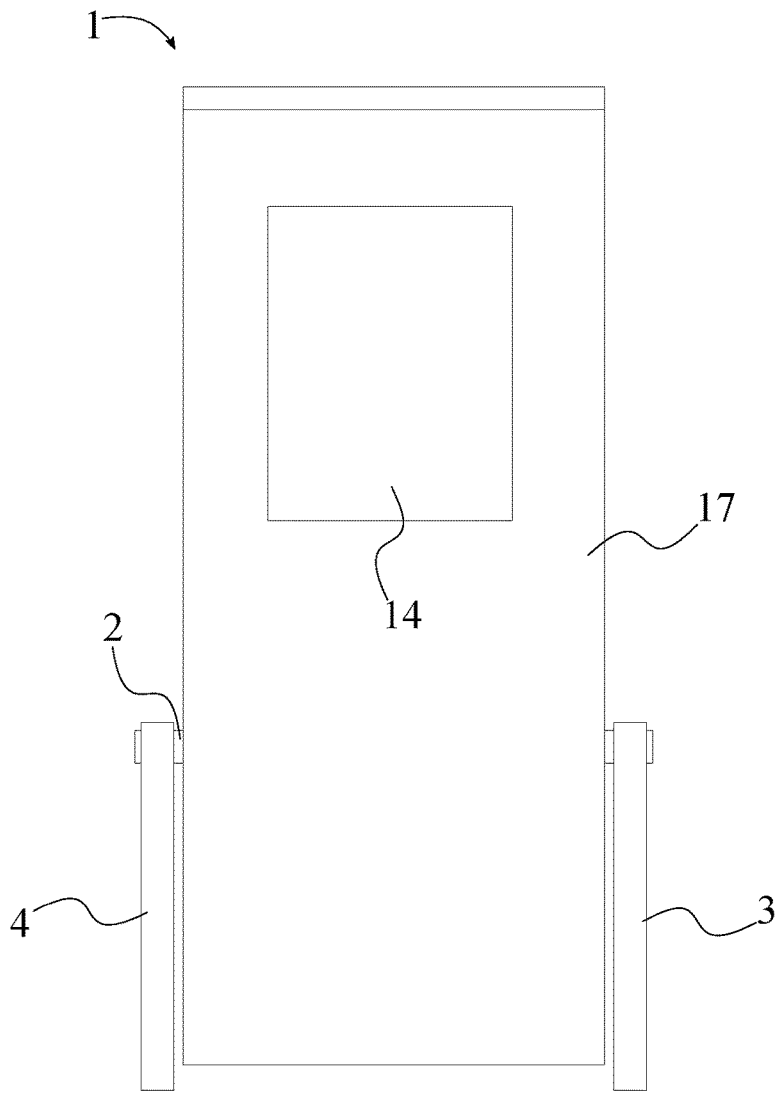
FIG. 6 is a front view of the present invention, wherein the present invention is configured in the open configuration.
Figure 7:
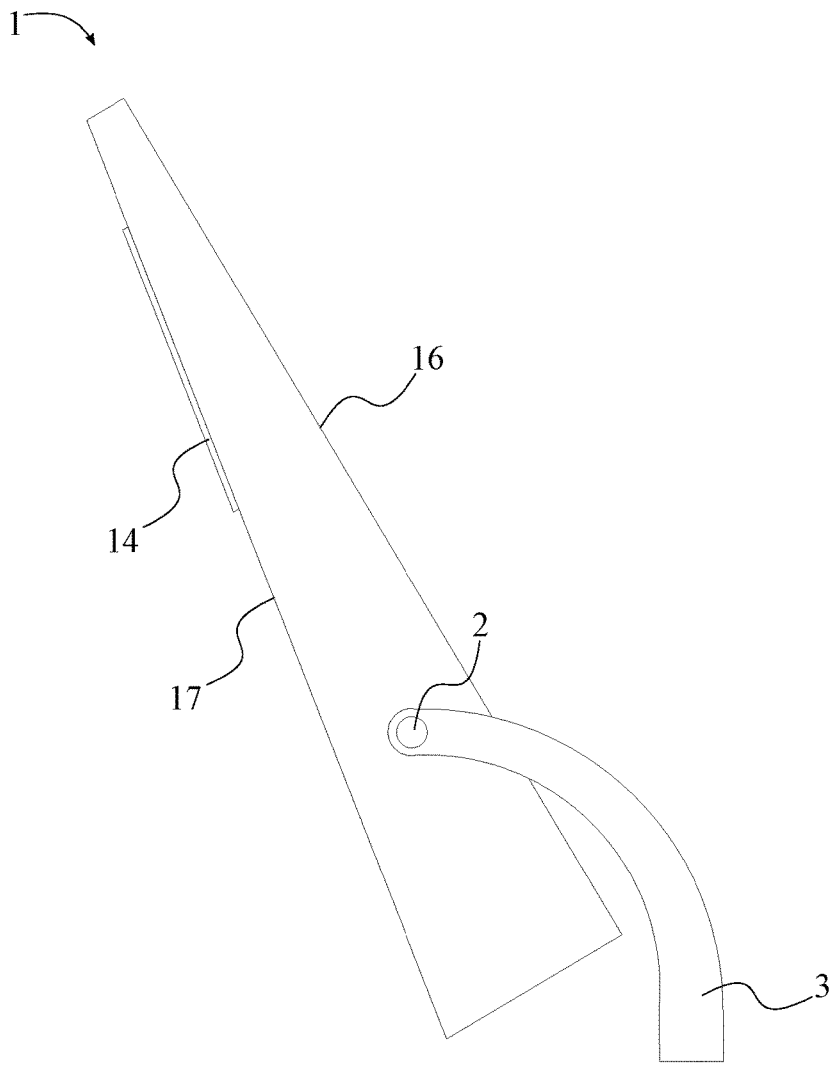
FIG. 7 is right view of the present invention, wherein the present invention is configured in the closed configuration.

In accordance to FIG. 1 and FIG. 2, the present invention comprises a bridge deck 1, a fulcrum 2, a first fulcrum support 3, a second fulcrum support 4, a first fluid reservoir 5, a second fluid reservoir 6, and a fluid pump 7. The bridge deck 1 is the structural body that supports the weight of vehicles or pedestrians, as well as, the structural body that rotates as the present invention transitions from the open configuration to the closed configuration. The fulcrum 2 supports the weight of the bridge deck 1 and the fulcrum 2 is a pivoting axis for the bridge deck 1. The first fulcrum support 3 and the second fulcrum support 4 bear the weight of the fulcrum 2 and the bridge deck 1 to suspend the bridge deck 1 to span physical obstacles, such as roads, valleys, and bodies of water. The first fulcrum support 3 and the second fulcrum support 4 displace the bridge deck 1 from the physical obstacle, such that the rotation of the bridge deck 1 is not obstructed by the physical obstacle. The fulcrum 2 is perpendicularly connected to the first fulcrum support 3, in accordance to FIG. 3. Similarly, the fulcrum 2 is perpendicularly connected to the second fulcrum support 4. The first fulcrum support 3 is oppositely positioned to the second fulcrum support 4 along the fulcrum 2. The bridge deck 1 is pivotably connected to the fulcrum 2 and the fulcrum 2 traverses through the bridge deck 1. The bridge deck 1 is positioned between the first fulcrum support 3 and the second fulcrum support 4. In this configuration, the bridge deck 1 is able to pivot about the fulcrum 2 without obstruction from the first fulcrum support 3 and the second fulcrum support 4 to transition the present invention from the closed configuration, shown in FIG. 1, and the open configuration, shown in FIG. 5.

The first fluid reservoir 5 and the second fluid reservoir 6 are vessels that contain a quantity of fluid. The fluid is preferred to be a liquid compound or mixture that is inert with the material of the first fluid reservoir 5 and the second fluid reservoir 6 to prevent degradation from within the first fluid reservoir 5 and the second fluid reservoir 6. Detailed in FIG. 2, the first fluid reservoir 5 is internally mounted to the bridge deck 1. Similarly, the second fluid reservoir 6 is internally mounted to the bridge deck 1. The fulcrum 2 is positioned between the first fluid reservoir 5 and the second fluid reservoir 6, such that the difference in weight between the contents of the first fluid reservoir 5 and the second fluid reservoir 6 determines the angular position of the bridge deck 1 about the fulcrum 2. The quantity of fluid is transported between the first fluid reservoir 5 and the second fluid reservoir 6 through the fluid pump 7. The fluid pump 7 is internally mounted to the bridge deck 1. The first fluid reservoir 5 is in fluid communication with the second fluid reservoir 6 through the fluid pump 7 such that the fluid pump 7 is able to produce a pressure difference to transport the quantity of fluid from the first fluid reservoir 5 to the second fluid reservoir 6.

In accordance to the preferred embodiment of the present invention, the present invention further comprises a first fluid conduit 8 and a second fluid conduit 9, shown in FIG. 2 and FIG. 8 to FIG. 10. The first fluid conduit 8 and the second fluid conduit 9 facilitate the transport for the quantity of fluid between the first fluid reservoir 5 and the second fluid reservoir 6. The first fluid conduit 8 is adjacently connected to the first fluid reservoir 5. The first fluid conduit 8 is adjacently connected to second fluid reservoir 6. Similarly, the second fluid conduit 9 is adjacently connected to the first fluid reservoir 5. The second fluid conduit 9 is adjacently connected to second fluid reservoir 6. The fluid pump 7 is integrated along the first fluid conduit 8. The first fluid reservoir 5 is in fluid communication with the second fluid reservoir 6 through the first fluid conduit 8 and the fluid pump 7. The second fluid reservoir 6 is in fluid communication with the first fluid reservoir 5 through the second fluid conduit 9. In this configuration, the quantity of fluid is able to be pumped from the first fluid reservoir 5, through the first fluid conduit 8, and into the second fluid reservoir 6 in order to shift a center of gravity of the bridge deck 1 and rotate the bridge deck 1 from the open configuration to the closed configuration. Subsequently, the quantity of fluid is able to be drained from the second fluid reservoir 6, through the second fluid conduit 9, and into the first fluid reservoir 5, again shifting the center of gravity of the bridge deck 1 to return the bridge deck 1 from the closed configuration to the open configuration.

Figure 8:
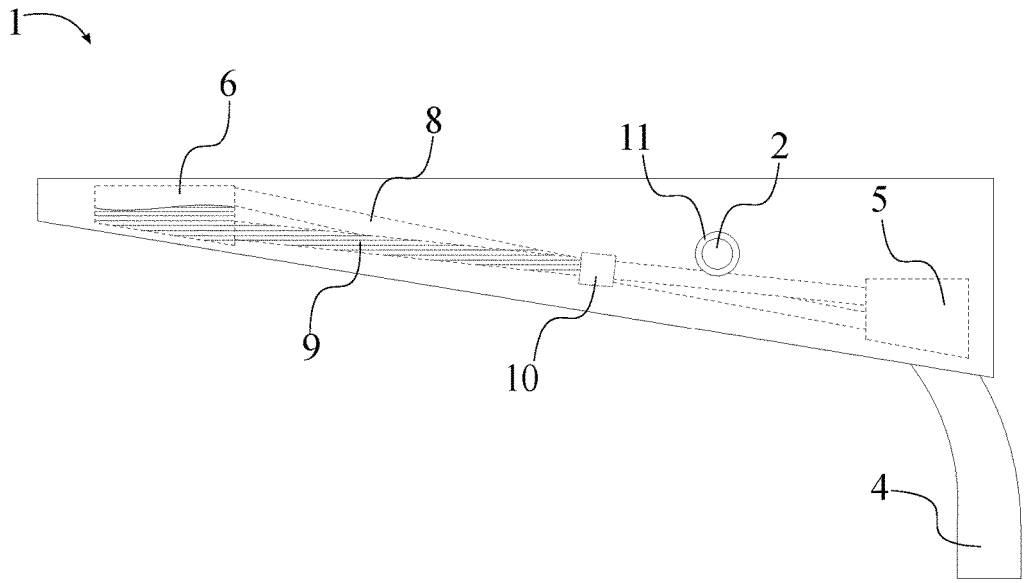
FIG. 8 is schematic diagram of the present invention, detailing the position for the quantity of fluid, wherein the present invention is in the closed configuration.
Figure 9:
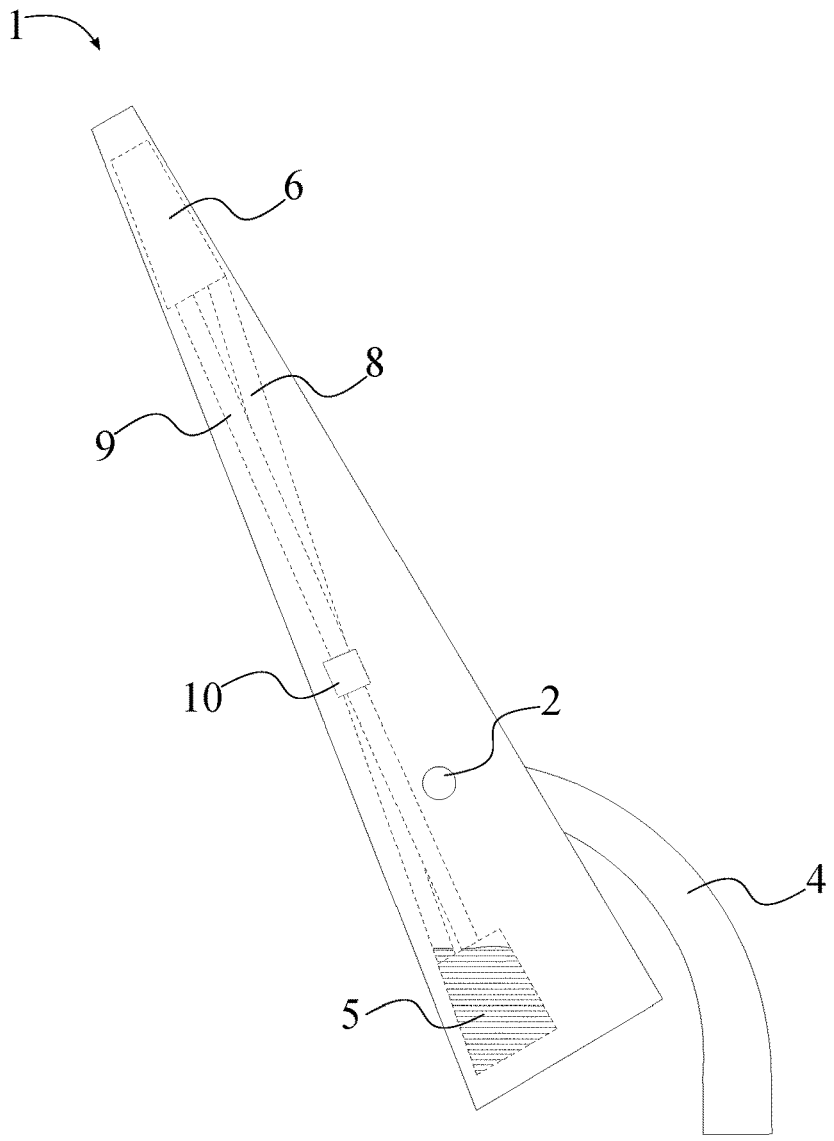
FIG. 9 is schematic diagram of the present invention, detailing the position for the quantity of fluid, wherein the present invention is in the open configuration.

In the closed configuration, the second fluid reservoir 6 is elevated from the first fluid reservoir 5, such that the quantity of fluid is gravity fed from the second fluid reservoir 6 to the first fluid reservoir 5, shown in FIG. 2 and FIG. 8. More specifically, the preferred embodiment of the present invention further comprises a flow restriction valve 10, in accordance to FIG. 2 and FIG. 8 to FIG. 10. The flow restriction valve 10 prevents the quantity of fluid from draining through the second fluid conduit 9 as the quantity of fluid is being pumped into the second fluid reservoir 6 in order to retain a portion of the quantity of fluid within the second fluid reservoir 6. The flow restriction valve 10 is integrated along the second fluid conduit 9 to prevent the transport of fluid through the second fluid conduit 9, shown in FIG. 8. The flow restriction valve 10 may be partially opened to control the speed that the bridge deck 1 rotates about the fulcrum 2 from the closed configuration to the open configuration, shown in FIG. 9.

Further in accordance to the preferred embodiment of the present invention, the present invention comprises a bearing assembly 11, detailed in FIG. 8. The bearing assembly 11 reduces frictional forces between the bridge deck 1 and the fulcrum 2 as the bridge deck 1 rotates around the fulcrum 2. The bridge deck 1 is pivotably connected to the fulcrum 2 through the bearing assembly 11 such that bridge deck 1 rotates more freely about the fulcrum 2 as the quantity of fluid is transported from the first fluid reservoir 5 and the second fluid reservoir 6.

Figure 10:
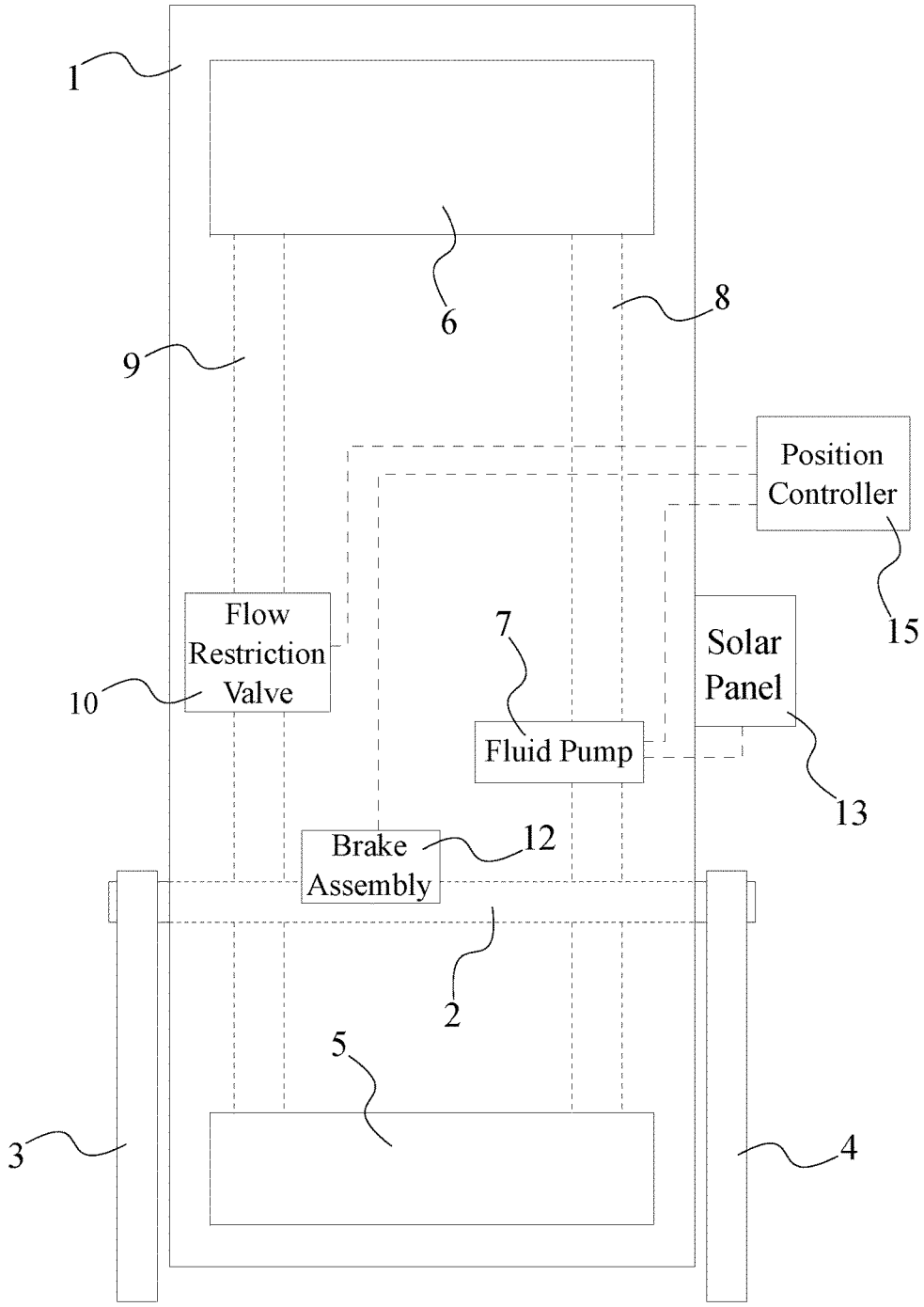
FIG. 10 is schematic diagram of the present invention, detailing the electrical components of the present invention.

Still in accordance to the preferred embodiment of the present invention, the present invention comprises a brake assembly 12, illustrated in FIG. 10. The brake assembly 12 allows the angular velocity for the rotation of the bridge deck 1 to be controlled. The brake assembly 12 is internally mounted to the bridge deck 1. The brake assembly 12 is adjacently positioned to the fulcrum 2. The brake assembly 12 frictionally engages the fulcrum 2 to control the rotation of bridge deck 1 by applying a frictional force to reduce the speed that the bridge deck 1 rotates.

In some embodiments of the present invention, the present invention comprises at least one solar panel 13, shown in FIG. 10. The at least one solar panel 13 provides electrical energy to the fluid pump 7 to allow the fluid pump 7 to operate. The at least one solar panel 13 is mounted to the bridge deck 1. The at least one solar panel 13 is oriented skyward to receive sunlight in order for the at least one solar panel 13 to convert sunlight into electrical energy. The at least one solar panel 13 is electrically connected to the fluid pump 7 to provide the fluid pump 7 with electrical energy to transport the quantity of fluid from the first fluid reservoir 5 to the second fluid reservoir 6.

In some embodiments of the present invention, the present invention comprises an advertising mount 14 and the bridge deck 1 comprises a load-bearing surface 16 and a base surface 17, illustrated in FIG. 3, FIG. 4, FIG. 6, and FIG. 7. The advertising mount 14 is a support structure that a billboard, banner, or other advertisement is affixed to promote publicity. The load-bearing surface 16 is the surface which supports vehicle traffic, pedestrians, or other travel across the bridge deck 1. The base surface 17 is the surface oriented towards the physical obstacle spanned by the bridge deck 1. The load-bearing surface 16 is oppositely positioned to the base surface 17 about the fulcrum 2. The advertising mount 14 is adjacently connected to the base surface 17. The advertising mount 14 is oppositely oriented to the load-bearing surface 16. In the open configuration, the advertising mount 14 is visible to persons opposite to the bridge deck 1 across the physical object that the bridge deck 1 spans in the closed configuration.

In some other embodiments, the present invention comprises a position controller 15, detailed in FIG. 10. The position controller 15 is a process control device that is used to regulate the fluid pump 7, the flow restriction valve 10, and the brake assembly 12 in order for the transition between the open configuration and the closed configuration to be more consistent. The fluid pump 7 is electronically connected to the position controller 15. The position controller 15 actuates the fluid pump 7 to transport the quantity of fluid at a controlled rate to lower the bridge deck 1 at a constant rate. The flow restriction valve 10 is electronically connected to the position controller 15. The position controller 15 actuates the flow restriction valve 10 to control the flow of the quantity of fluid from the second fluid reservoir 6 to the first fluid reservoir 5. The brake assembly 12 is electronically connected to the position controller 15. The position controller 15 actuates the brake assembly 12 such that the brake assembly 12 engages the fulcrum 2 to slow the angular velocity of the bridge deck 1 about the fulcrum 2 to a specified safe velocity.

In some applications, each of a plurality of gravity drawbridges is connected to a computerized bridge tender through the corresponding position controller 15. The computerized bridge tender is a computing device utilized to manage the plurality of gravity bridges independently to ensure safe passage of water traffic and vehicle over a large geographical region. The computerized bridge tender is communicatively coupled to the position controller 15 for each gravity bridge of the plurality of gravity bridges in order to transmit control signals to manipulate each bridge deck 1 to transition between the open configuration and the closed configuration.

Although the invention has been explained in relation to its preferred embodiment, it is to be understood that many other possible modifications and variations can be made without departing from the spirit and scope of the invention as hereinafter claimed.

What is claimed is:

1. A gravity drawbridge comprises:
a bridge deck;
a fulcrum;
a first fulcrum support;
a second fulcrum support;
a first fluid reservoir;
a second fluid reservoir;
a fluid pump;
the fulcrum being perpendicularly connected to the first fulcrum support;
the fulcrum being perpendicularly connected to the second fulcrum support;
the first fulcrum support being oppositely positioned to the second fulcrum support along the fulcrum;
the bridge deck being pivotably connected to the fulcrum;
the fulcrum traversing through the bridge deck;
the bridge deck being positioned between the first fulcrum support and the second fulcrum support;
the first fluid reservoir being internally mounted to the bridge deck;
the second fluid reservoir being internally mounted to the bridge deck;
the fulcrum being positioned between the first fluid reservoir and the second fluid reservoir;
the fluid pump being internally mounted to the bridge deck; and
the first fluid reservoir being in fluid communication with the second fluid reservoir through the fluid pump.

2. The gravity drawbridge, as claimed in claim 1, comprises:
a bearing assembly; and
the bridge deck being pivotably connected to the fulcrum through the bearing assembly.

3. The gravity drawbridge, as claimed in claim 1, comprises:
a brake assembly;
the brake assembly being internally mounted to the bridge deck;
the brake assembly being adjacently positioned to the fulcrum; and
the brake assembly frictionally engaging the fulcrum.

4. The gravity drawbridge, as claimed in claim 1, comprises:
an advertising mount;
the bridge deck comprises a load-bearing surface and a base surface;
the load-bearing surface being oppositely positioned to the base surface about the fulcrum;
the advertising mount being adjacently connected to the base surface; and
the advertising mount being oppositely oriented to the load-bearing surface.

5. The gravity drawbridge, as claimed in claim 1, comprises:
a position controller; and
the fluid pump being electronically connected to the position controller.

6. The gravity drawbridge, as claimed in claim 1, comprises:
a first fluid conduit;
a second fluid conduit;
the first fluid conduit being adjacently connected to the first fluid reservoir;
the first fluid conduit being adjacently connected to the second fluid reservoir;
the second fluid conduit being adjacently connected to the first fluid reservoir;
the second fluid conduit being adjacently connected to the second fluid reservoirs;
the fluid pump being integrated along the first fluid conduit;
the first fluid reservoir being in fluid communication with the second fluid reservoir through the first fluid conduit and the fluid pump; and
the second fluid reservoir being in fluid communication with the first fluid reservoir through the second fluid conduit.

7. The gravity drawbridge, as claimed in claim 6, comprises:
wherein the bridge deck is in a closed configuration; and
the second fluid reservoir being elevated from the first fluid reservoir.

8. The gravity drawbridge, as claimed in claim 6, comprises:
a flow restriction valve; and
the flow restriction valve being integrated along the second fluid conduit.

9. The gravity drawbridge, as claimed in claim 1, comprises:
at least one solar panel;
the at least one solar panel being mounted to the bridge deck; and
the at least one solar panel being electrically connected to the fluid pump.

10. The gravity drawbridge, as claimed in claim 9, comprises:
a flow restriction valve; and
the flow restriction valve being electronically connected to the position controller.

11. The gravity drawbridge, as claimed in claim 9, comprises:
a brake assembly; and
the brake assembly being electronically connected to the position controller.

* * * * *